United States Patent [19]

Yashiro

[11] 4,020,878

[45] May 3, 1977

[54] METHOD AND APPARATUS FOR MAKING ANNULAR METALLIC BLANKS

[75] Inventor: Kazuyoshi Yashiro, Kure, Japan

[73] Assignee: Benda Kogyo Co., Ltd., Japan

[22] Filed: Oct. 23, 1975

[21] Appl. No.: 625,105

[30] Foreign Application Priority Data

Aug. 19, 1975 Japan ..... 50-100551

[52] U.S. Cl. ..... 140/88; 29/412; 72/130

[51] Int. Cl.[2] ..... B21F 37/00

[58] Field of Search ..... 140/88; 29/156.62, 412; 72/129, 130; 10/86 B

[56] References Cited

UNITED STATES PATENTS

| | | | |
|---|---|---|---|
| 1,801,363 | 4/1931 | Mueller | 29/412 |
| 3,938,235 | 2/1976 | Wendt et al. | 140/88 |

*Primary Examiner*—Lowell A. Larson
*Attorney, Agent, or Firm*—Wenderoth, Lind & Ponack

[57] ABSTRACT

A method and apparatus for making annular metallic blanks for metallic rings having a desired inner diameter wherein an elongated metallic material having a predetermined cross-section is formed into a spiral shape having an inner diameter smaller than that of said rings and such formed material is loosely and coaxially disposed around a cylindrical member the outer diameter of which is usually smaller than the inner diameter of said spiral material but can be made larger than said inner diameter of said inner diameter of said ring. Next, said cylindrical member is enlarged to thereby make said inner diameter of said spiral material larger than said inner diameter of said desired ring, then said enlarged spiral material disposed around said cylindrical member is cut along a straight line parallel to the axis of the cylindrical means to provide a plurality of bends of the spiral material; thereafter, said enlarged cylindrical member is reduced to its original diameter, and the bends are removed from said cylindrical member to be used as annular metallic blanks for said metallic rings.

In order to obtain a desired ring from the annular blank formed as described above, the ends of the annular blank are joined together by welding such as the so-called but welding operation.

6 Claims, 6 Drawing Figures

METHOD AND APPARATUS FOR MAKING ANNULAR METALLIC BLANKS

BACKGROUND OF INVENTION

This invention relates to a method and apparatus for producing metallic rings which are, for example, employed to fabricate starting ring gears for a motor vehicle or the like, in particular, to a method and apparatus for producing annular metallic blanks for the metallic rings above.

There are two conventional methods for producing steel rings which are employed to fabricate ring gears or the like.

In one of the conventional methods for producing steel rings, an elongated steel material such as steel bar is bent into an annular shape and, then, the opposite ends of such formed steel material are joined together by a welding operation. However, according to that method, when the steel material is bent into annular shape, the ends of the material are left unformed or straight because the ends are held by gripping means while the material is being bent. Thus, when the ends of the annular material are welded together, the straight ends have to be cut off; then the ends of the remaining material which has been bent to a predetermined curvature are welded together. The cut off ends are waste. Furthermore, the ends formed by cutting off the straight part of the annular material are separated from each other and have to be butted against each other before they are welded together. The butting operation, however, results in application of an excess amount of stress to the material which may cause deformation of the material into oval or the like shape other than a true circle. In order to check and rectify the deviation from the desired true circle shape, further labor is required and checking and rectifying operation adds an additional cost to the production of the rings. Furthermore, since any steel material generally has a variation or deviation in carbon content therein over the length of the material, various positions of the steel material will have somewhat different curvatures and rectifying operation of such different curvatures will also require additional labor and expense.

In the second conventional method, a thick steel clyinder is sliced into a plurality of rings, the diameter of the steel cylinder having a predetermined diameter the same as that of the desired ring products so that the rings formed are, themselves, used as ring products.

In this method, however, a substantial amount of material is washed as cutting chips when the steel cylinder is sliced, thus resulting in increased production costs. Furthermore, the obtained rings are subjected to uneven stress while they are being cut from the steel cylinder and in consequence, the configuration of the obtained rings will come to be distorted even if the steel cylinder has a relatively precise circular configuration. Such distortion of configuration has to be corrected or rectified and, as with the first conventional method described above, this requires a substantial increase in man hours and expenditure.

With the above disadvantages of the prior art above in mind, the applicant previously invented a new method and apparatus and disclosed them in Japanese Pat. application No. 29353/1975 filed on Mar. 11, 1975, entitled "A Method and Apparatus for Making Annular Metallic Blanks for Metallic Rings". According to the invention disclosed in the Japanese Application above, a length of elongated metallic material, such as steel bar having a predetermined or desired cross-section configuration, is formed into a spiral member having a diameter smaller than that desired for rings to be formed, the spiral member is forcibly coaxially disposed around or put on a cylindrical portion of a holding means which has a diameter greater than that of the desired ring, and then, the spiral member is cut along a straight line parallel to the axis of the cylindrical portion to provide a plurality of bends. Thereafter, such bends are removed from the cylindrical portion to obtain annular blanks for rings.

In order to obtain a desired ring from the annular blank formed in accordance with the invention as described above, the ends of the annular blank are brought together in an abutting relationship and are joined together by a welding operation.

According to the invention described above, since a preformed spiral member is forcibly disposed about the cylindrical portion having an outer diameter greater than that of the spiral member, deviation or variation in curvature in several portions of the spiral member which may be inevitable when the spiral member is formed by merely bending the metallic material such as steel bar, for instance, due to variation in carbon content with respect to the length of the material, can be rectified, and, thus, the deviation or variation in curvature of the annular blanks made from such a spiral member can be eliminated. Accordingly, the rings made from such annular blanks have substantially no the deviation or variation in curvature thereof and the invention can solve the difficulty inherent in the first conventional method as described hereinabove. Furthermore, the ends of the annular blanks produced as described above remain in an abutting relationship so little or no external force needs to be applied to position them for welding. The invention makes it easy to produce rings having a desired diameter without substantial variation in the radius of curvature.

Furthermore, the material loss in the above-mentioned invention is small in comparison with that of the first and second prior art methods described above.

However, it was found that the invention has the disadvantage as described below. That is in coaxially disposing the spiral member about the cylindrical portion, each of turns of the spiral member disposed around the cylindrical portion is caused with circumferencial relative movement with respect to the adjacent turns so as to conform to the cylindrical portion having the diameter larger than that of the spiral member and, thus, a substantial amount of frictional force is generated between the adjacent convolutions or turns of the spiral member as well as between the spiral member and the cylindrical portion. Therefore, it is necessary to apply a substantial pressure on one end face of the spiral member in the axial direction thereof in order to push the spiral member to the predetermined position about the cylindrical portion along the axial direction of cylindrical portion. Further, such a great axial pressure, in turn, increases the frictional force between the turns so that the circumferential relative motion of each turn of the spiral member as described above cannot be freely effected. However, when such turns are forcibly pushed around the cylindrical portion, the turns are subjected to plastic deformation which causes inconvenience in the subsequent working process. Furthermore, it is difficult to uniformly effect the operation for forcibly disposing the spiral member about the cylindrical portion.

SUMMARY OF INVENTION

The present invention is an improvement of my invention disclosed in Japanese, Pat. application No. 29353/1975 described above.

According to the present invention a hollow cylindrical member, the outer diameter of which is smaller than an inner diameter of a spiral member, if employed in place of the solid cyclindrical portion in the above-mentioned Japanese Patent Application, and the hollow cylindrical member is provided with a slit parallel to the axis thereof extending the height of the cylindrical member so that the outer diameter of the hollow cylindrical portion can be enlarged to that of the rigid cylindrical portion in the above-mentioned Japanese invention by forcibly inserting a cylindrical mandrel into the hollow cylindrical portion. The mandrel has a diameter larger than the inner diameter of the hollow cylindrical portion. Thus, the preformed spiral member is loosely disposed about or put on the hollow cylindrical portion and, then, the mandrel is forcibly inserted into the cylindrical portion to thereby enlarge the cylindrical portion and, accordingly, enlarge the spiral member. Thereafter, the enlarged spiral member is cut along a straight line parallel to the axis thereof in the same way as in the invention of Japanese Pat. application No. 29353/1975.

Accordingly, the present invention can eliminate the disadvantages in the invention of Japanese Patent application above while retaining the advantages obtained therein.

The above and other objects and attendant advantages of the present invention will be more readily apparent to those skilled in the art from a reading of the following description when read in conjunction with the accompanying drawings which show preferred embodiments of the invention for illustration purpose only, but not for limiting the scope of the same in any way.

DESCRIPTION OF PREFERRED EMBODIMENTS

In the method of this invention, first of all, a length of elongated metallic material such as a steel strip or bar having a predetermined cross-section such as a rectangle, circle, etc. is formed into a spiral-shaped member 10. In forming such spiral-shaped member 10, the metallic material as described above is subjected to a series of conventional cold-bending steps to form a plurality of turns. In this connection, it is to be noted that the inner diameter of such formed member 10 should be smaller that that desired for the metallic rings as final products.

Figure 1:
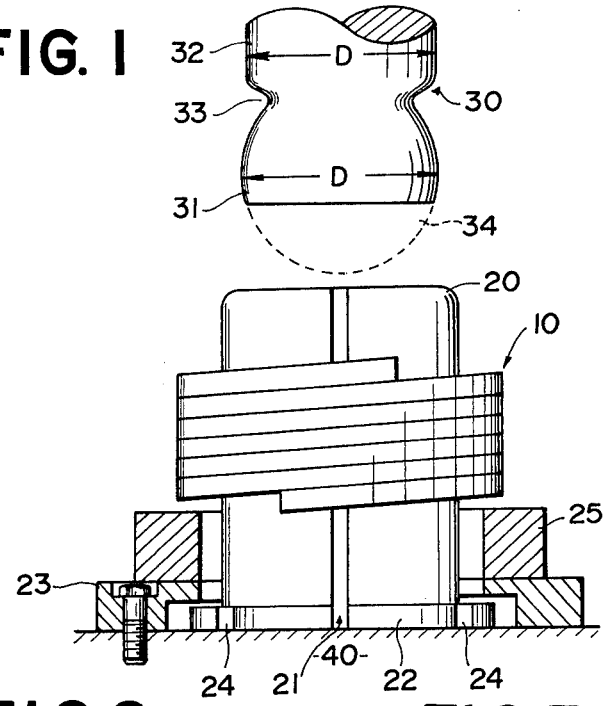
FIG. 1 is a front view partly in section of an apparatus in accordance with the present invention showing the apparatus in an initial stage in the annular blank producing operation in which a spiral member is loosely and coaxially disposed around the hollow cylindrical member.
Figure 2:
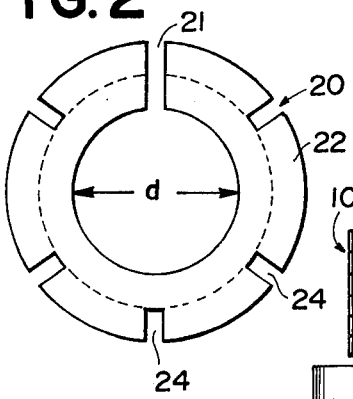
FIG. 2 is a plan view of the hollow cylindrical member of the apparatus shown in FIG. 1.

The spiral material 10 is, as shown in FIG. 1, loosely and coaxially disposed around hollow cylindrical member 20 the outer diameter of which is usually smaller than the inner diameter of the spiral member 10, but can be made larger than the inner diameter of the member 10 as described hereinafter. From the relationship of the diameters as described above, the spiral member 10 is easily disposed around the member 20. The hollow cylindrical member 20 may be a thick cylinder of elastic metallic material such as steel and is provided with a slit 21 parallel to the axis thereof so as to vary the diameter thereof. In the preferred embodiment illustrated, a flange 22 is provided at the lower portion of the cylindrical member 20 so that the member 20 is fixedly held with respect to a base 40 in conjunction with a annular holding member 23 secured to the base 40. As shown in FIGS. 1 and 2, the flange 22 is provided with a plurality of notches 24, 24 . . . therein in order to reduce resistance to deformation or enlargement of the cylindrical member 20. The cylindrical member 20 may be subjected to a nitriding process or a carburizing process so that resistance to wear of the inner and outer surfaces thereof is improved while the toughness of the cylindrical member is maintained.

Figure 3:
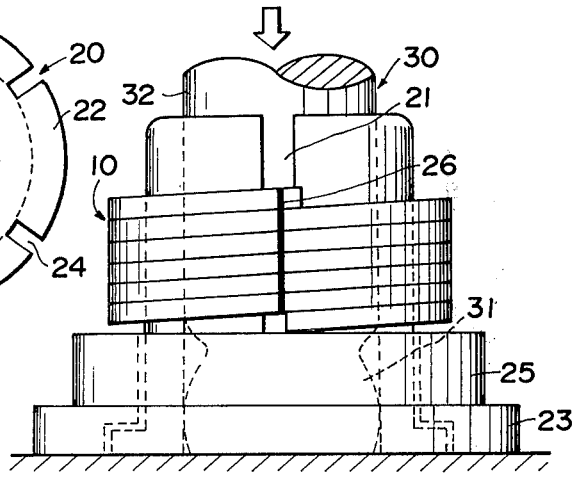
FIG. 3 is similar to FIG. 1 but shows said apparatus in a second stage in the annular blank producing operation in which a mandrel is forcibly inserted into the cylindrical member so that the spiral member is enlarged.

A mandrel 30 is then forcibly inserted into the hollow cylindrical member 20 as shown in FIG. 3. The diameter D of the mandrel 30 is such that the diameter *d* of the cylindrical member 20 is enlarged upon the insertion of the mandrel thereinto, whereupon the diameter of the spiral member disposed around the member 20 is enlarged. The mandrel 30 is generally cylindrical in shape; however, for the purpose of facilitating the insertion of the mandrel, the mandrel 30 as shown in FIG. 1 comprises a spherical portion 31 connected to a cylindrical portion 32 by a reduced diameter portion 33. However, as described hereinafter, the spherical portion 31 may be exchanged for a tapered portion provided on the lower end of the cylindrical portion 32. Further, the spherical portion 31 may not be perfectly spherical and the lower portion thereof as designated by the numeral 34 in FIG. 1 may be cut off. The mandrel is preferably subjected to a heat treatment process so as to improve its wearability.

Figure 4:
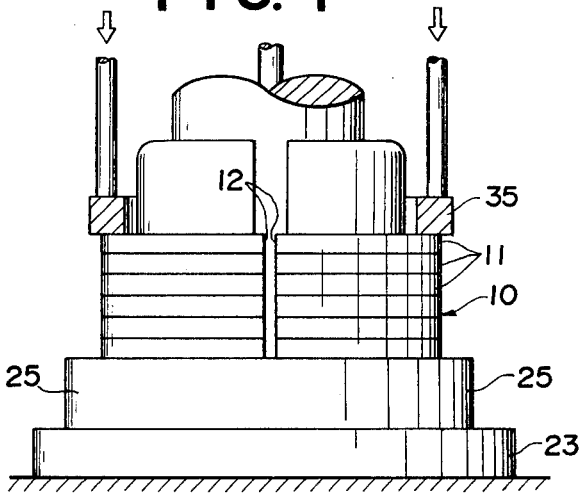
FIG. 4 is also similar to FIG. 1 but shows said apparatus in a third stage in the annular blank producing operation in which the enlarged spiral member has been cut along a vertical line and the ends of each bend are opposed to each other by pressing the upper end face of the spiral member by means of the pusher ring.

When the mandrel 30 having the spherical portion 31 as shown in FIG. 1 is employed, it is desirable that the cylindrical portion 32 be placed inside of the spiral member 10 disposed around the cylindrical member 20 and, thus, as shown in FIGS. 1, 3 and 4, an annular member 25 is provided on the holding member 23 so that the spherical portion 31 is received within the extent of the height defined by the annular member 25 and holding member 23.

As shown in FIG. 3, the spiral member 10 enlarged around the cylindrical member 20 is, then, cut along a straight cutting line 26 by a proper cutting device. The cutting line 26 is preferably aligned with the slit 21 of the cylindrical member 20.

Figure 5:
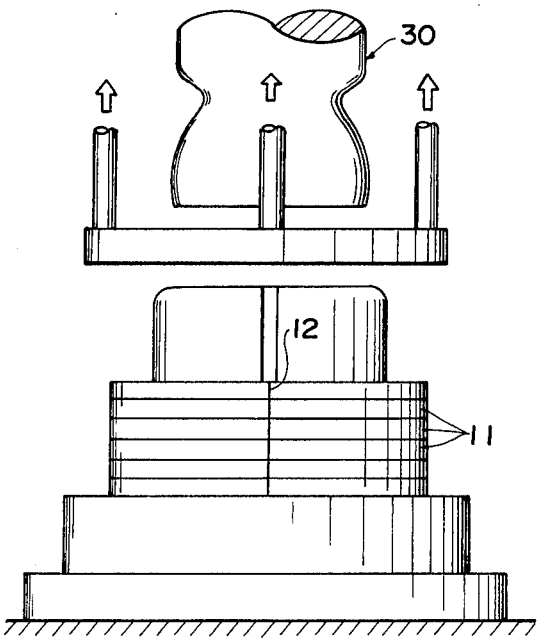
FIG. 5 shows the apparatus shown in FIG. 1 in a final stage in the annular blank producing operation in which the mandrel is retracted from the cylindrical member so as to reduce the cylindrical portion to its original condition.

By the cutting operation above, the spiral member is cut into a plurality of bends 11, 11 . . . . Should the bends 11, 11 . . . be left as they have been formed, the ends of each bend are staggered on different planes. Thus, as shown in FIG. 4, an annular pressing member 35 is downwardly urged against the upper end face of the spiral member 10 so as to oppose the opposite end of each turn 11. Then, the annular pressing member 35 and mandrel 30 are retracted from the cylindrical member 20 so that the cylindrical member 20, as shown in FIG. 5, returns to the same condition as shown in FIG. 1 and the ends 12, 12 of the bends 11, 11 . . . are positioned in abutting relationship to make the bends 11, 11 . . . into annular blanks. Under such condition, it is required that the inner diameter of the annular blanks 11, 11 . . . be larger than the outer diameter of the cylindrical member 20 so that blanks can be easily removed from the cylindrical member 20.

Incidentally, the relationship between the flange 22 of the cylindrical member 20 and the holding member 23 is determined so that the enlargement of the cylindrical member 20 caused by inserting the mandrel 30 into the cylindrical member 20 is freely effected or the enlargement above is not interfered with by the holding member 23.

Figure 6:
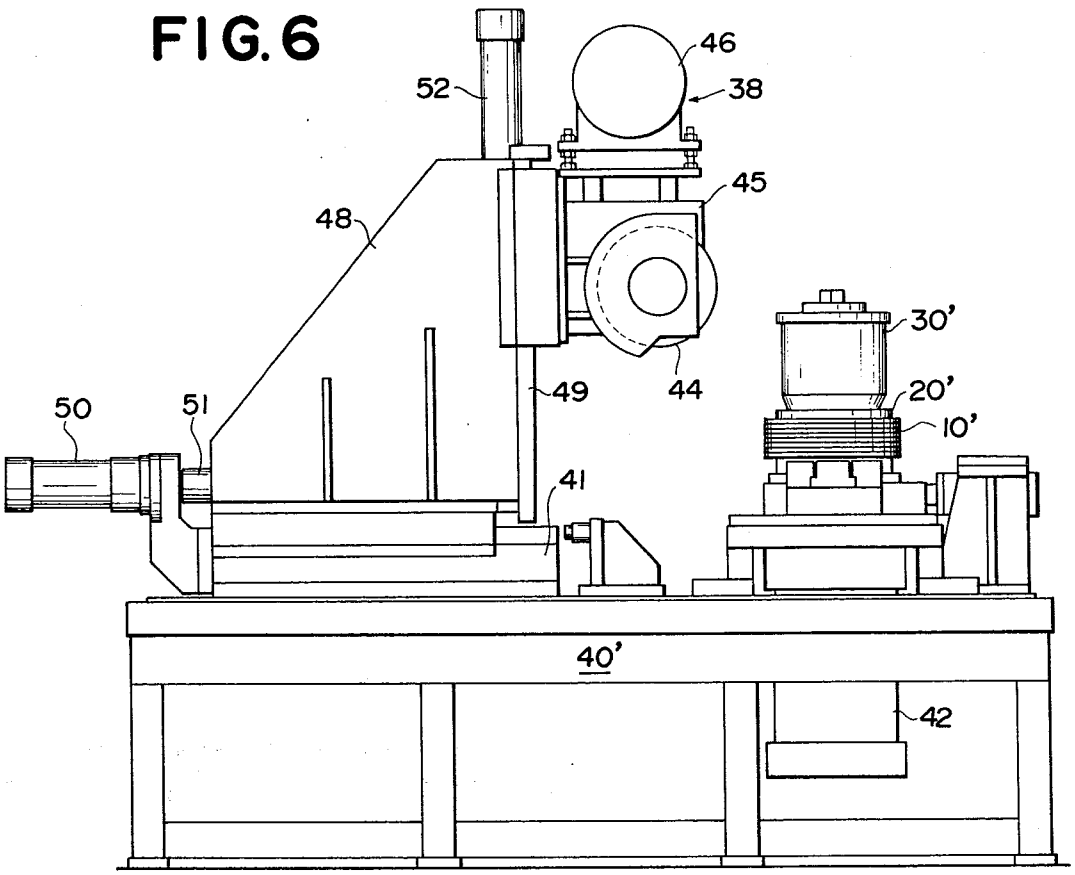
FIG. 6 shows a front view of another apparatus in accordance with the present invention.

Referring to FIG. 6, there is shown an apparatus of another embodiment of the present invention. This apparatus is generally similar to that shown in FIGS. 1 – 5. The apparatus comprises a bed frame 40′, a hollow cylindrical member 20′, a mandrel 30′ and a cutting device 38 for cutting a spiral member 10′. The mandrel 30′ is, in general, cylindrical and is provided with a tapered portion 31′ at the lower end thereof in order to facilitate the insertion thereof into the cylindrical member 20′. In this apparatus, the mandrel is connected to a rod (not shown) of a fluid cylinder device 42 provided on the lower portion of the bed frame 40′, the rod being operable to downwardly pull the mandrel 30′ and insert the mandrel into the cylindrical member 20′ by means of the cylinder device 42. The cutting device 38 comprises a body 48 and cutting head 45 having a rotary cutter 44 and a motor 46 therefore. The body 48 is mounted on a horizontal rail 41 fixed on the bed frame 40′ for horizontal movement and is driven by a horizontal fluid cylinder device 50 connected by a rod 51 of the device 50. The cutting head 45 is slidably mounted on a vertical rail 49 for vertical movement and is driven by a fluid vertical cylinder device 52 which is connected to the cutting head 45 by a rod (not shown). The cutting operation is preferably effected by the combination of the operation of the motor 46 and both the cylinder device' 50 and 52.

The annular blank producing operation of this apparatus is effected in the same manner as described in connection with the first embodiment shown in FIGS. 1 – 5.

In order to form rings as final products from the annular blanks 11, 11 . . . produced in accordance with this invention, the ends of the blank 11, after being positioned in abutting relationship, are welded by a conventional butt-welding operation. Flash butt welding is preferable because it is easy to control the length of material of the ends to be consumed in the flash butt welding. In this connection, it is to be noted that the inner circumferential length of the annular blank is dimensioned to include the inner circumferential length of the desired rings and the length of material to be consumed in butt welding and, hence, the outer circumferential length of the cylindrical member 20 which is enlarged by insertion of the mandrel 30 should be dimensioned to include the inner circumferential length of the annular blank as described above and the length of material to become metal chips in cutting operation of the spiral member.

The ring so formed is so precise that the ring can be directly subjected to gear cutting operation to obtain a starting ring gear without any machining.

In the foregoing description has been made of only one embodiment of the invention, but it will readily occur to those skilled in the art that the same is illustrative in nature, and does not limit the scope of the invention in any way. The scope of the invention is only limited by the appended claims.

What I claim is:

1. An apparatus for making annular blanks for rings having a predetermined inner diameter used to fabricate ring gears, said apparatus comprising:

a hollow circumferentially expandable cylindrical member having a longitudinal slit therethrough parallel to the axis thereof for aiding in the expansion of said member;

cylindrical mandrel means insertable into said cylindrical member for expanding said cylindrical member, said mandrel means being of sufficient diameter to expand said cylindrical member to an outside diameter greater than the inside diameter of said rings having a predetermined inner diameter;

a spiral member coaxially and loosely positioned around said cylindrical member while said cylindrical member is not expanded, whereby expanding said cylindrical member by inserting said mandrel means thereinto causes said cylindrical member to expand against and expand said spiral member; and cutting means adjacent said cylindrical member and said spiral member for cutting said spiral member along a straight line parallel to the axis of said cylindrical member after said cylindrical member with said spiral member theresurrounding are expanded by the insertion of said mandrel means, whereby after said spiral member is cut by said cutting means, a plurality of blanks are formed for forming said rings.

2. An apparatus as claimed in claim 1, wherein said spiral member is comprised of a carbon steel bar having a substantially rectangular cross-section which is subjected to a cold-bending operation to form a spiral having an inner diameter smaller than the predetermined inner diameter of said rings and larger than the outside diameter of said non-expanded cylindrical member.

3. An apparatus as claimed in claim 1, wherein the ends of said blanks formed by cutting said spiral member with said cutting means are butt welded together to form said rings.

4. An apparatus as claimed in claim 3, wherein the inner circumferential length of said spiral member, after being expanded by the insertion of said mandrel means into said cylindrical member, is predetermined to include the inner circumferential length of said rings, taking into consideration the material consumed during said cutting operation and the length of material consumed during butt welding the ends of said blanks formed during said cutting operation.

5. An apparatus as claimed in claim 1, further comprising annular pressing member means above said cylindrical member having an inner diameter larger than the outer diameter of said expanded cylindrical member for pressing against said expanded spiral member, whereby pressing said spiral member with said pressing member means causes the ends of said blanks formed during said cutting operation to oppose each other.

6. An apparatus as claimed in claim 1, wherein said cylindrical mandrel means is tapered at the end thereof adjacent said cylindrical member, whereby insertion into said cylindrical member is facilitated.

* * * * *